US005356345A

United States Patent [19]

Peuplie et al.

[11] Patent Number: 5,356,345

[45] Date of Patent: Oct. 18, 1994

[54] CHALK HOLDING DEVICE FOR A POOL CUE

[76] Inventors: Robert E. Peuplie; Robert E. Peuplie, II, both of 306 N. 4th St., Perkasie, Pa. 18944

[21] Appl. No.: 169,405

[22] Filed: Dec. 20, 1993

[51] Int. Cl.[5] ..... A63D 15/16

[52] U.S. Cl. ..... 473/36

[58] Field of Search ..... 473/35, 36, 37, 38, 473/39

[56] References Cited

U.S. PATENT DOCUMENTS

| | | | |
|---|---|---|---|
| 437,746 | 10/1890 | Barber | 473/36 |
| 507,471 | 10/1893 | Berger | 473/36 |
| 516,472 | 3/1894 | Campbell | 473/36 |
| 3,843,120 | 10/1974 | Rocci | 473/36 |

*Primary Examiner*—Theatrice Brown
*Attorney, Agent, or Firm*—Michael J. Colitz, Jr.

[57] ABSTRACT

A chalk holder for coupling to a pool cue comprising, in combination a first holder component having cylindrical side walls, an open rearward end and a closed forward end, the forward end having a central hole with a screw for mounting to the rear end of a pool cue with the bumper removed; a second holder component having cylindrical side walls, an open forward end and a closed rearward end, the diameter of the side walls of the second holder component being less than the diameter of the cylindrical side walls of the first holder component to allow its reciprocal movement there within for thereby defining a cylindrical volume between the cylindrical walls of the second holder component, the closed forward end of the first holder component and the closed rearward end of the second holder component; coupling elements to releasable join the first holder component and second holder component, such elements including a pair diametrically opposed, interiorally directed, radial pins secured to the cylindrical side walls of the first holder component and cooperable slots formed axially into the second holder component extending from the forward open end and terminating in circumferential slots whereby rotation and axle movement between the first and second holder components will couple and separate the first and second holder component; a cylindrical piece of chalk located within the cylindrical volume for use by a player; and a bumper formed with a central aperture with a screw for coupling the bumper with the rearward end of the second holder component.

6 Claims, 4 Drawing Sheets

FIG 4
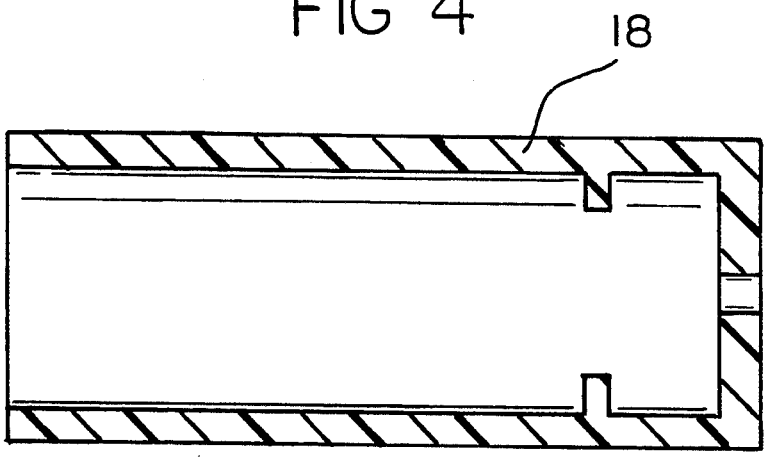
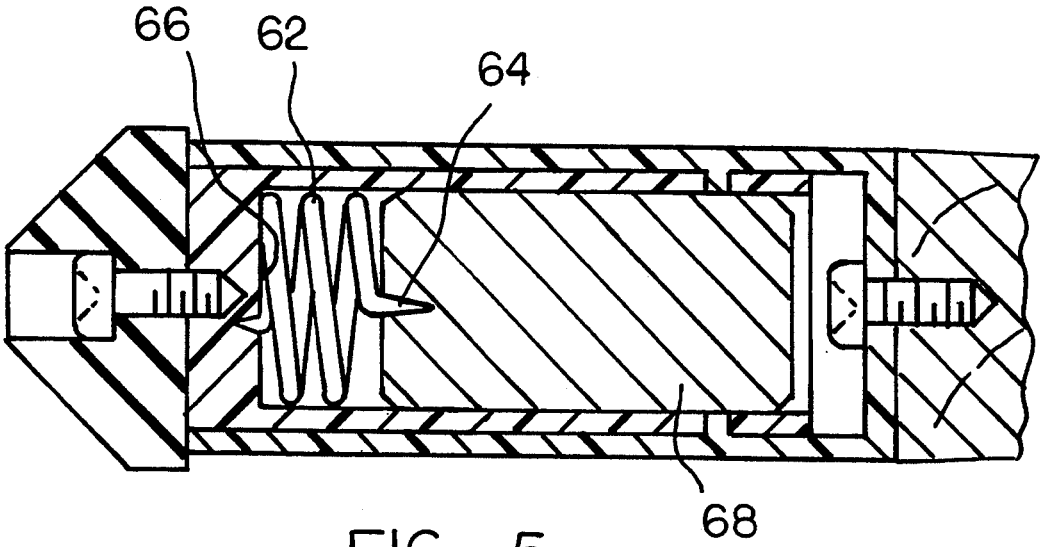
FIG 5

CHALK HOLDING DEVICE FOR A POOL CUE

BACKGROUND OF THE INVENTION

1. Field of the Invention

The present invention relates to a chalk holding device for a pool cue and more particularly pertains to a device attractable to a pool cue for holding the chalk of a player.

2. Description of the Prior Art

The use of pool chalk devices is known in the prior art. More specifically, pool chalk devices heretofore devised and utilized for the purpose of holding chalk more convenient to pool shooters are known to consist basically of familiar, expected and obvious structural configurations, notwithstanding the myriad of designs encompassed by the crowded prior art which have been developed for the fulfillment of countless objectives and requirements.

Prior art attempts to render chalk for the tips of pool cues more convenient are disclosed in U.S. Pat. Nos. 4,953,770 to Bond and 5,046,728 to Haddock. Such devices simply relate to the supporting a cube of chalk and removably clipping it to a convenient surface remote from the cue. Another prior art patent of interest is U.S. Pat. No. 23,315 to Matteson. Such patent simply relates to a generally cube like support for chalk to be used in association with a pool cue. Again, there is no teaching of coupling the chalk with respect to the cue for convenient personal utilization.

In this respect, the chalk holding device for a pool cue according to the present invention substantially departs from the conventional concepts and designs of the prior art, and in so doing provides-an apparatus primarily developed for the purpose of rendering chalk more convenient to pool shooters.

Therefore, it can be appreciated that there exists a continuing need for new and improved chalk holding device for a pool cue which can be readily deployed and utilized. In this regard, the present invention substantially fulfills this need.

SUMMARY OF THE INVENTION

In view of the foregoing disadvantages inherent in the known types of pool chalk devices now present in the prior art, the present invention provides an improved chalk holding device for a pool cue. As such, the general purpose of the present invention, which will be described subsequently in greater detail, is to provide a new and improved chalk holding device for a pool cue apparatus and method which has all the advantages of the prior art and none of the disadvantages.

To attain this, the present invention essentially comprises a chalk holder for coupling to a pool cue comprising, in combination a first holder component having cylindrical side walls, an open rearward end and a closed forward end, the forward end having a central hole with a screw for mounting to the rear end of a pool cue with the bumper removed; a second holder component having cylindrical side walls, an open forward end and a closed rearward end, the diameter of the side walls of the second holder component being less than the diameter of the cylindrical side walls of the first holder component to allow its reciprocal movement there within for thereby defining a cylindrical volume between the cylindrical walls of the second holder component, the closed forward end of the first holder component and the closed rearward end of the second holder component; coupling elements to releasable join the first holder component and second holder component, such elements including a pair diametrically opposed, interiorally directed, radial pins secured to the cylindrical side walls of the first holder component and cooperable slots formed actually into the second holder component extending from the forward open end and terminating in circumferential slots whereby rotation and axle movement between the first and second holder components will couple and separate the first and second holder component; a cylindrical piece of chalk located within the cylindrical volume for use by a player; and a bumper formed with a central aperture with a screw for coupling the bumper with the rearward end of the second holder component.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

An even further object of the present invention is to provide a new and improved chalk holding device for a pool cue which is susceptible of a low cost of manufacture with regard to both materials and labor, and which accordingly is then susceptible of low prices of sale to the consuming public, thereby making such chalk holding devices for a pool cue economically available to the buying public.

Still yet another object of the present invention is to provide a new and improved chalk holding device for a pool cue which provides in the apparatuses and methods of the prior art some of the advantages thereof, while simultaneously overcoming some of the disadvantages normally associated therewith.

Still another object of the present invention is to simplify the deployment and use of chalk for pool shooters.

Yet another object of the present invention is to render the game of pool more enjoyable by having chalk always accessible to the player.

Even still another object of the present invention is to provide a new and improved chalk holder for coupling to a pool cue comprising, in combination a first holder component having cylindrical side walls, an open rearward end and a closed forward end, the forward end having a central hole with a screw for mounting to the rear end of a pool cue with the bumper removed; a second holder component having cylindrical side walls, an open forward end and a closed rearward end, the diameter of the side walls of the second holder component being less than the diameter of the cylindrical side walls of the first holder component to allow its reciprocal movement there within for thereby defining a cylindrical volume between the cylindrical walls of the second holder component, the closed forward end of the first holder component and the closed rearward end of the second holder component; coupling elements to releasable join the first holder component and second holder component, such elements including a pair diametrically opposed, interiorally directed, radial pins secured to the cylindrical side walls of the first holder component and cooperable slots formed actually into the second holder component extending from the forward open end and terminating in circumferential slots whereby rotation and axle movement between the first and second holder components will couple and separate the first and second holder component; a cylindrical piece of chalk located within the cylindrical volume for use by a player; and a bumper formed with a central aperture with a screw for coupling the bumper with the rearward end of the second holder component.

These together with other objects of the invention, along with the various features of novelty which characterize the invention, are pointed out with particularity in the claims annexed to and forming a part of this disclosure. For a better understanding of the invention, its operating advantages and the specific Objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a sectional view taken along line 4—4 of FIG. 3.

FIG. 5 is a sectional view similar to FIG. 2 but illustrating an alternate embodiment of the invention.

DESCRIPTION OF THE PREFERRED EMBODIMENT

Figure 1:
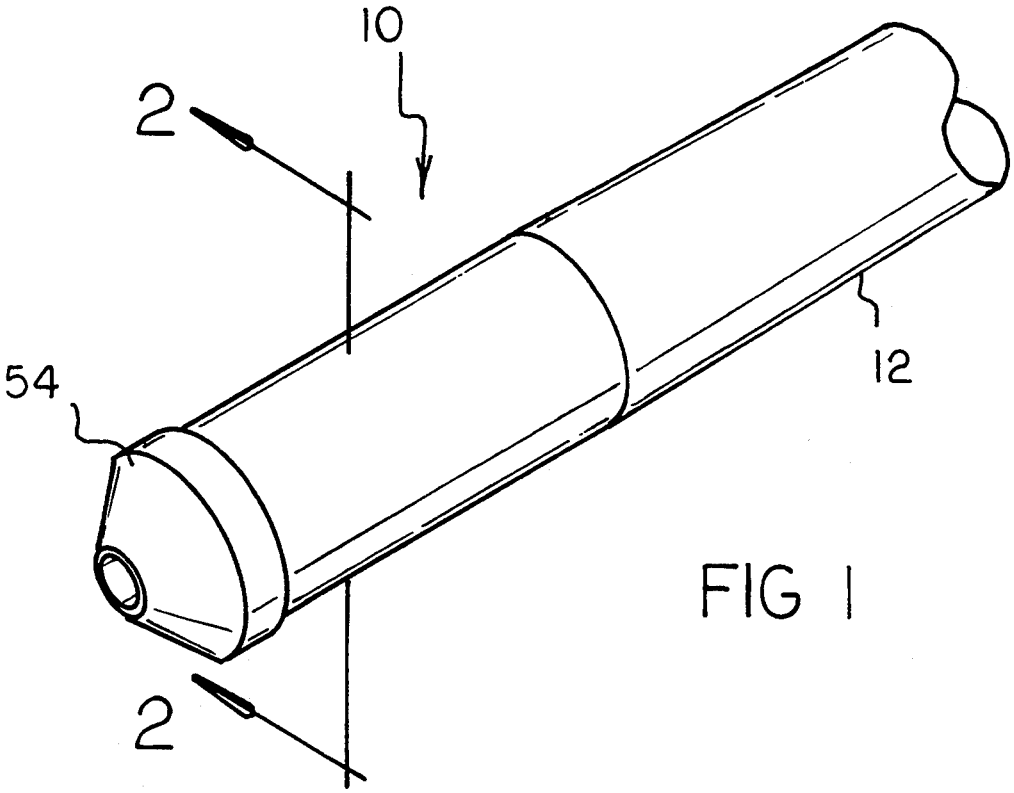
FIG. 1 is a perspective illustration rear end of a pool cue employing the chalk holding device for a pool cue of the present invention.
Figure 2:
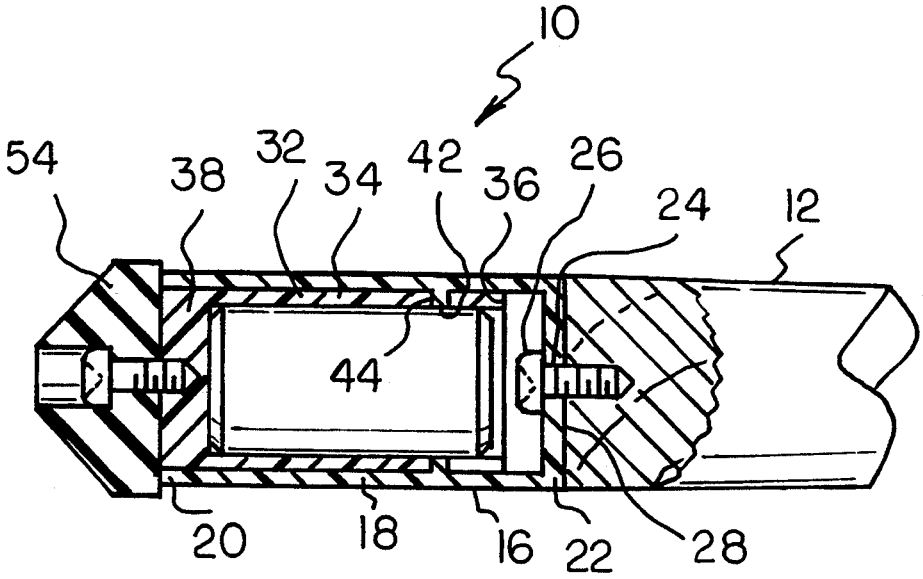
FIG. 2 is a sectional view taken line 2—2 of FIG. 1.
Figure 3:
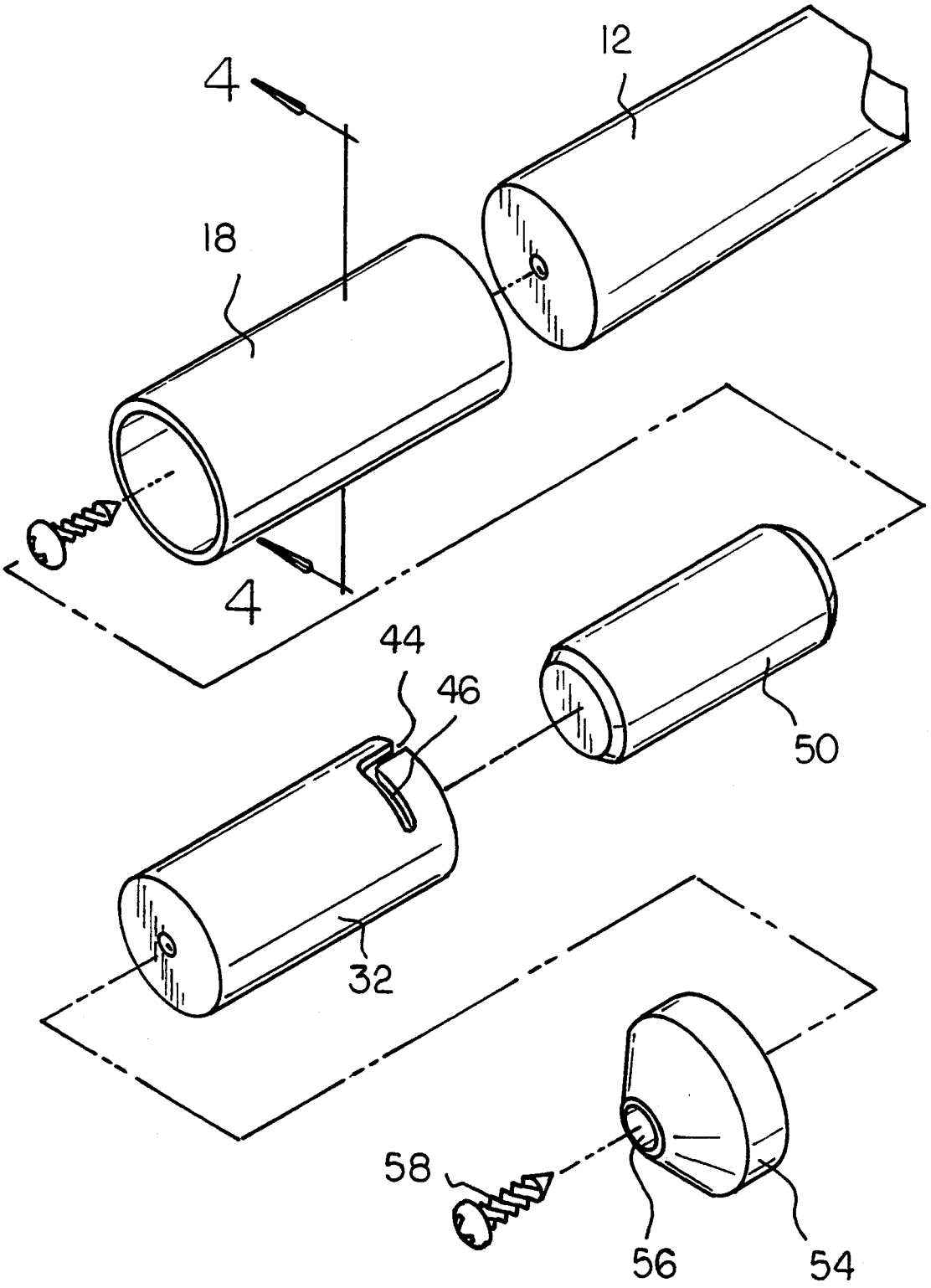
FIG. 3 is an exploded perspective view of the chalk holding device for a pool cue as shown in FIG. 1.

With reference now to the drawings, and in particular to FIG. 1 thereof, a new and improved chalk holding device for a pool cue embodying the principles and concepts of the present invention and generally designated by the reference numeral 10 will be described.

More specifically, as can be seen in FIGS. 1 through 4, there is a disclosed chalk holder 10 for coupling to a pool cue 12. The holder comprises a first holder component 16. Such component has cylindrical side walls 18, an open rearward end 20 and a closed forward end 22. The forward end 22 has a central hole 24 with a screw 26 for mounting to the rear end 28 of a pool cue 12 after the bumper has been removed.

A second holder component 32 has cylindrical side walls 34, an open forward end 36 and a closed rearward end 38. The diameter of the side walls 34 of the second holder component is less than the diameter of the cylindrical side walls 18 of the first holder component. This allows its reciprocal movement therewithin for thereby defining a cylindrical volume space between the cylindrical walls of the second holder component, the closed forward end of the first holder component and the closed rearward end of the second holder component.

Coupling elements are provided between the two components function to releasable join the first holder component 16 and second holer component 32. Such elements including a pair diametrically opposed, interiorally directed, radial pins 42. Such pins are secured to the cylindrical side walls of the first holder component 16. Cooperable detent slots 44 are formed axially into the second holder component extending from the forward open end and terminating in circumferential slots 46. In this manner rotation and axle movement between the first and second holder components will couple and separate the first and second holder component.

Used in association with the holder is a cylindrical piece of chalk 50 located within the cylindrical volume for use by a player.

Lastly, the chalk holder includes a bumper 54 is formed with a central aperture 56 with a screw 58 for coupling such bumper 54 with the rearward end of the second holder component.

In an alternate embodiment of the invention, as shown in FIG. 5, the device include a coil spring 62. Such spring has a pointed axle ends 64 and 66 extending outwardly therefrom. One of the axle ends 64 is impaled into the axis of the chalk 68 within the cylindrical volume. The other pointed end 66 is secured into the rearward end of the second holder component 32.

Figure 6:
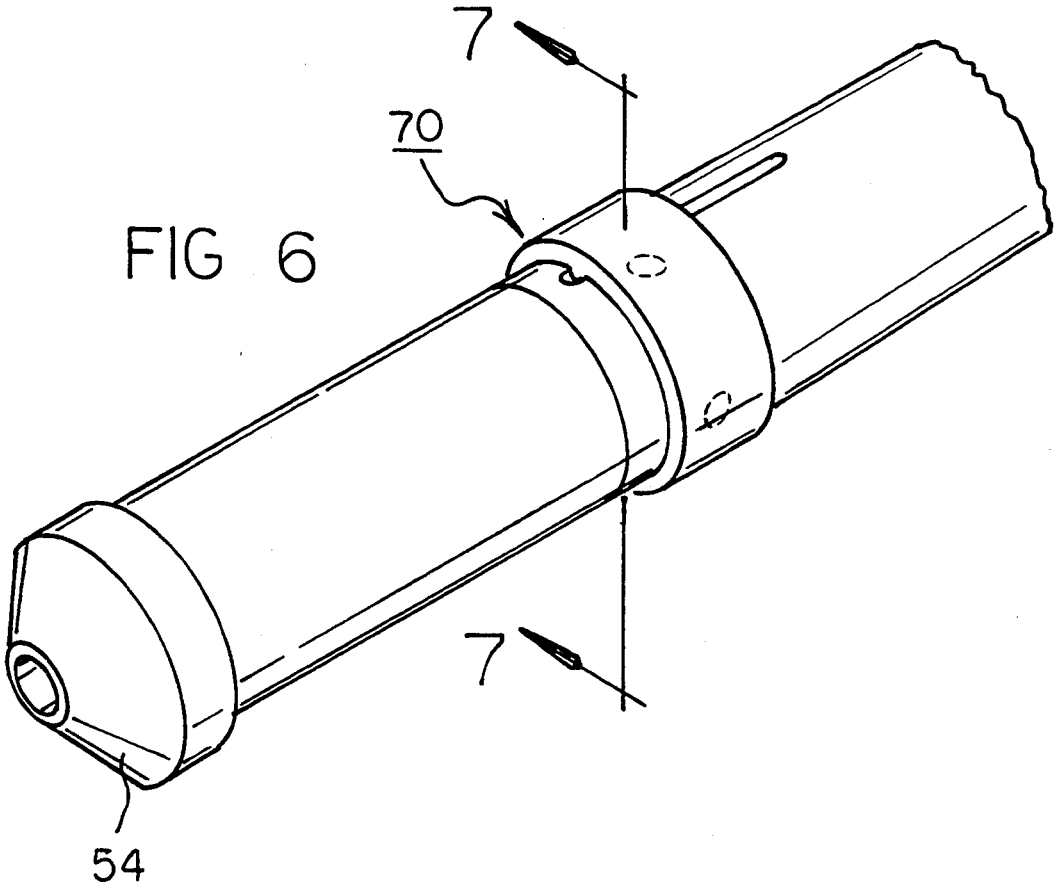
FIG. 6 is yet an additional alternate embodiment of the invention.
Figure 7:
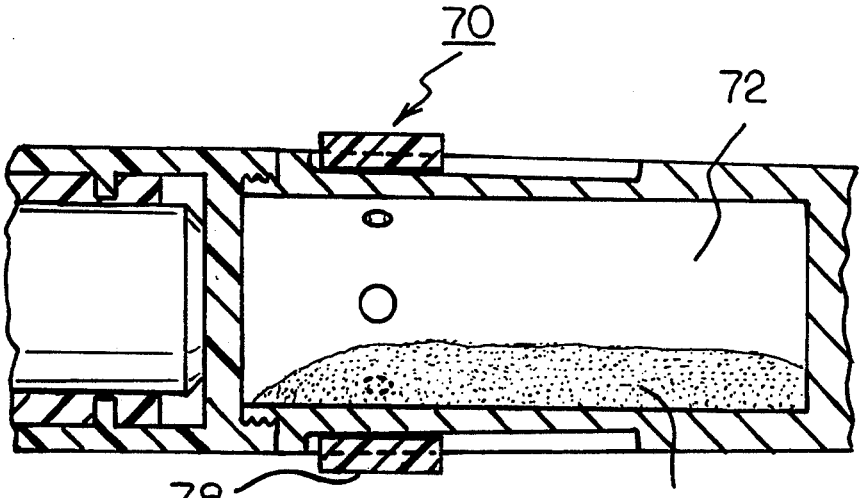
FIG. 7 is a sectional view taken along line 7—7 of FIG. 6.

FIGS. 6 and 7 show an additional alternate embodiment of the invention. Such embodiment further includes talc dispensing mechanisms 70. The talc dispensing mechanisms including a rearwardly directed generally cylindrical recess 72 formed forwardly from the rearward end of the cue with the bumper removed. A quantity of talcum powder 74 is located within the recess. A plurality-of radial holes 76 are formed in the cue for defecting the flow of talc from interior of the cue to exteriors thereof.

Releasable coupling means 78 in the form of a ring is located between the cue and the forward end of the exterior holder component. Such ring 78 is adapted to be moved axially with respect to the cue between a first position covering the holes, note FIG. 7, and a second operative positioning for opening the holes and allowing the dispensing of talcum powder therefrom.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A chalk holder for coupling to a pool cue comprising, in combination;

a first holder component having cylindrical side walls, an open rearward end and a closed forward end, the forward end having a central hole with a screw for mounting to the rear end of a pool cue;

a second holder component having cylindrical side walls, an open forward end and a closed rearward end, the diameter of the side walls of the second holder component being less than the diameter of the cylindrical side walls of the first holder component to allow its reciprocal movement therewithin for thereby defining a cylindrical volume between the cylindrical walls of the second holder component, the closed forward end of the first holder component and the closed rearward end of the second holder component;

coupling elements to releasable join the first holder component and second holder component, such elements including a pair diametrically opposed, interiorally directed, radial pins secured to the cylindrical side walls of the first holder component and cooperable slots formed axially into the second holder component extending from the forward open end and terminating in circumferential slots whereby rotation and axle movement between the first and second holder components will couple and separate the first and second holder component;

a cylindrical piece of chalk located within the cylindrical volume for use by a player; and a bumper having a central aperture and a screw for coupling the bumper with the rearward end of the second holder component.

2. A chalk holder for coupling to a pool cue comprising:

a first holder component having cylindrical side walls, an open rearward end and a closed forward end, the forward end having a central hole with a screw for mounting to the rear end of a pool cue;

a second holder component having cylindrical side walls, an open forward end and a closed rearward end, the diameter of the side walls of the second holder component being less than the diameter of the cylindrical side walls of the first holder component to allow its reciprocal movement therewithin for thereby defining a cylindrical volume between the cylindrical walls of the second holder component, the closed forward end of the first holder component and the closed rearward end of the second holder component; and coupling elements to releasable join the first holder component and second holder component, such elements including a pair diametrically opposed, interiorally directed, radial pins secured to the cylindrical side walls of the first holder component and cooperable detent slots formed axially into the second holder component extending from-the forward open end and terminating in circumferential slots whereby rotation and axle movement between the first and second holder components will couple and separate the first and second holder component and a bumper having a central aperture and attachment means for coupling said bumper to the rearward end of said second holder compartment.

3. The device as set forth in claim 2 and further including:

a cylindrical piece of chalk located within the cylindrical volume for use by a player.

4. The device as set forth in claim 2 wherein said attachment means is a screw.

5. The apparatus as set forth in claim 3 and further including:

a coil spring having pointed axle ends extending outwardly therefrom, one of the axle ends being entailed into the axis of the chalk within the cylindrical volume and the other pointed end being secured into the rearward end of the second holder component.

6. The apparatus as set forth in claim 2 and further including:

talc dispensing mechanisms, the talc dispensing mechanisms including a rearwardly directed generally cylindrical recess formed forwardly from the rearward end of the cue with the bumper removed; a quantity of talcum powder located within the recess; a plurality of radial holes formed in the cue for defecting the flow of talc from interior of the cue to exteriors thereof; and releasable coupling means between the cue and the forward end of the exterior holder component and a cylindrical slide member adapted to be moved axially with respect to the cue between a first position covering the holes and a second operative positioning for opening the holes and allowing the dispensing of talcum powder therefrom.

* * * * *